US008233822B2

(12) United States Patent
Kim et al.

(10) Patent No.: US 8,233,822 B2
(45) Date of Patent: Jul. 31, 2012

(54) BELT HAVING A MEANDERING PREVENTION GUIDE AND IMAGE FORMING APPARATUS HAVING THE SAME

(75) Inventors: Tae-hyun Kim, Hwaseong-si (KR); Hee-won Jung, Suwon-si (KR); Yong-hoon Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 390 days.

(21) Appl. No.: 12/410,505

(22) Filed: Mar. 25, 2009

(65) Prior Publication Data

US 2010/0046986 A1 Feb. 25, 2010

(30) Foreign Application Priority Data

Aug. 25, 2008 (KR) ..... 10-2008-0083009

(51) Int. Cl.
*G03G 15/00* (2006.01)
*G03G 15/16* (2006.01)
*G03G 15/20* (2006.01)

(52) U.S. Cl. ..... 399/162; 399/165; 399/303; 399/312; 399/313; 399/329

(58) Field of Classification Search ..... 399/162, 399/165, 303, 312, 313, 329
See application file for complete search history.

(56) References Cited

U.S. PATENT DOCUMENTS

| | | | | |
|---|---|---|---|---|
| 5,659,850 | A * | 8/1997 | Reeder et al. | 399/165 |
| 6,816,691 | B2 * | 11/2004 | Kabata et al. | 399/165 |
| 6,871,038 | B2 * | 3/2005 | Fujiwara | 399/303 |
| 6,928,256 | B2 * | 8/2005 | Matsuda et al. | 399/165 |
| 7,136,611 | B1 * | 11/2006 | Murase | 399/165 |
| 7,242,897 | B2 * | 7/2007 | Satoh et al. | 399/313 |
| 7,680,445 | B2 * | 3/2010 | Kim | 399/165 |
| 7,738,825 | B2 * | 6/2010 | Ito | 399/313 |
| 7,957,685 | B2 * | 6/2011 | Shimizu | 399/313 |
| 2006/0172097 | A1 * | 8/2006 | Morikoshi et al. | |
| 2009/0011882 | A1 * | 1/2009 | Kichise et al. | |
| 2009/0169275 | A1 * | 7/2009 | Watanabe et al. | |
| 2010/0203994 | A1 * | 8/2010 | Fujikawa et al. | |

FOREIGN PATENT DOCUMENTS

JP 2003057895 A * 2/2003

* cited by examiner

*Primary Examiner* — Susan Lee
(74) *Attorney, Agent, or Firm* — Stanzione & Kim, LLP

(57) ABSTRACT

A belt configured to travel a continuous track may be incorporated for use in an image forming apparatus. The belt may include a guide member formed on a surface of the belt to prevent a belt from meandering off of the track, where the guide member may include a rubber sheet and a carbon black material having a primer particle diameter ranging from about 15 nm to about 35 nm. An image forming apparatus incorporating the belt with one or more guide members has an increased resistance to abrasion and mitigates belt meandering and image contamination.

17 Claims, 5 Drawing Sheets

BELT HAVING A MEANDERING PREVENTION GUIDE AND IMAGE FORMING APPARATUS HAVING THE SAME

CROSS-REFERENCE TO RELATED APPLICATIONS

This application claims priority under 35 U.S.C. §119 (a) of Korean Patent Application No. 10-2008-0083009, filed on Aug. 25, 2008, in the Korean Intellectual Property Office, the disclosure of which is incorporated herein by reference in its entirety.

TECHNICAL FIELD

The present disclosure relates to a belt used in an image forming apparatus and, more particularly, to a guide member of improved resistance against abrasion, which is formed on a belt to prevent belt meandering.

BACKGROUND OF RELATED ART

The use of computers and computer components such as printers, scanners, copiers, or multifunction units has increased over the years.

An electrophotographic image forming apparatus, such as a printer, a copier, a facsimile, a multifunction unit, or the like, generally includes a photoconductive medium, a light exposure device to irradiate a laser beam onto the photoconductive medium to form an electrostatic latent image thereon based on image data, a developing device to feed toner onto the photoconductive medium to form a visible image based on the electrostatic latent image, and a transfer device to transfer the developed latent image onto a paper sheet or other medium.

Conventional image forming apparatuses may typically employ one or more belts for, e.g., developing and, or transferring an image to a medium. However, as an inner or outer surface of the belt contacts other devices, such as a roller, the belt may experience friction and stresses, which may cause the belt to drop from or meander off of the track. In order to prevent a belt from meandering, guide members may be formed at predetermined locations of the belt to keep the belt on the track. However, conventional guide members may often cause friction with the rotating belt, causing the guide members to wear and emit dust, for example. The dust contaminates the belt, as well as other components within the image forming apparatus body, thereby, e.g., interfering with smooth toner transfer. Furthermore, the belt, such as, e.g., transfer belt, fusing belt, or photosensitive belt, is not consumable. It is desirable that the belts be operational as long as the image forming apparatus is in use. However, if the guide members are worn over a long period of use, it may be necessary to replace the belt, which may often be quite difficult and inconvenient. Thus, an improved belt and guide members are desired.

SUMMARY OF DISCLOSURE

A guide member of improved resistance, a belt incorporating the guide member, and an image forming apparatus incorporating the belt with the guide member are provided. The guide member is capable of preventing belt meandering without compromising an image quality of an image forming apparatus during processes such as formation of electrostatic latent image, toner transfer, or fusing of a toner image.

The foregoing and/or other aspects and utilities may be achieved by providing a belt for use in an image forming apparatus, the belt traveling a continuous track and including a guide member formed on a surface of the belt to prevent the belt from meandering. The guide member may include a rubber sheet and a carbon black. The carbon black may have a primer particle diameter ranging from about 15 nm to about 35 nm, for example. The carbon black may have a specific surface area of nitrogen absorption ranging from about 100 $mg^2/g$ to about 150 $mg^2/g$.

The carbon black may be a compound of two or more of materials selected from the group including Super Abrasion Furnace (SAF) carbon black, Super Abrasion Furnace-High Structure (SAF-HS) carbon black, Intermediate Super Abrasion Furnace (ISAF) carbon black, Intermediate Super Abrasion Furnace-High Structure (ISAF-HS) carbon black, and High Abrasion Furnace (HAF) carbon black.

The rubber sheet may include a polycarbonate urethane rubber sheet or a polyester urethane rubber sheet. The carbon black may be included in the rubber sheet in an amount ranging from about 20 phr to about 40 phr.

The belt may be selected from a photosensitive belt, a fusing belt and a transfer belt, for example.

An image forming apparatus may include a belt for traveling a continuous track, a driving roller to drive the belt, and a supporting roller to support the belt. The belt may include a guide member formed on a surface of the belt to prevent the belt from meandering, wherein the guide member may comprise a rubber sheet and a carbon black having a primer particle diameter ranging from about 15 nm to about 35 nm.

The carbon black may be a compound of two or more materials selected from the group including Super Abrasion Furnace (SAF) carbon black, Super Abrasion Furnace-High Structure (SAF-HS) carbon black, Intermediate Super Abrasion Furnace (ISAF) carbon black, Intermediate Super Abrasion Furnace-High Structure (ISAF-HS) carbon black, and High Abrasion Furnace (HAF) carbon black.

The carbon black may be included in the rubber sheet in an amount ranging from about 20 phr to about 40 phr.

The belt may be selected from a photosensitive belt, a fusing belt and a transfer belt, for example.

A guide member for use with a belt may be formed on an inner side surface of the belt to prevent a belt meandering, and the guide member may comprise a rubber sheet and a carbon black, in which the carbon black may have a primer particle diameter ranging from about 15 nm to about 35 nm.

The carbon black may be a compound of two or more of materials selected from the group of Super Abrasion Furnace (SAF) carbon black, Super Abrasion Furnace-High Structure (SAF-HS) carbon black, Intermediate Super Abrasion Furnace (ISAF) carbon black, Intermediate Super Abrasion Furnace-High Structure (ISAF-HS) carbon black, and High Abrasion Furnace (HAF) carbon black.

The carbon black may be included in the rubber sheet in an amount ranging from about 20 phr to about 40 phr, for example.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF SEVERAL EMBODIMENTS

Figure 1:
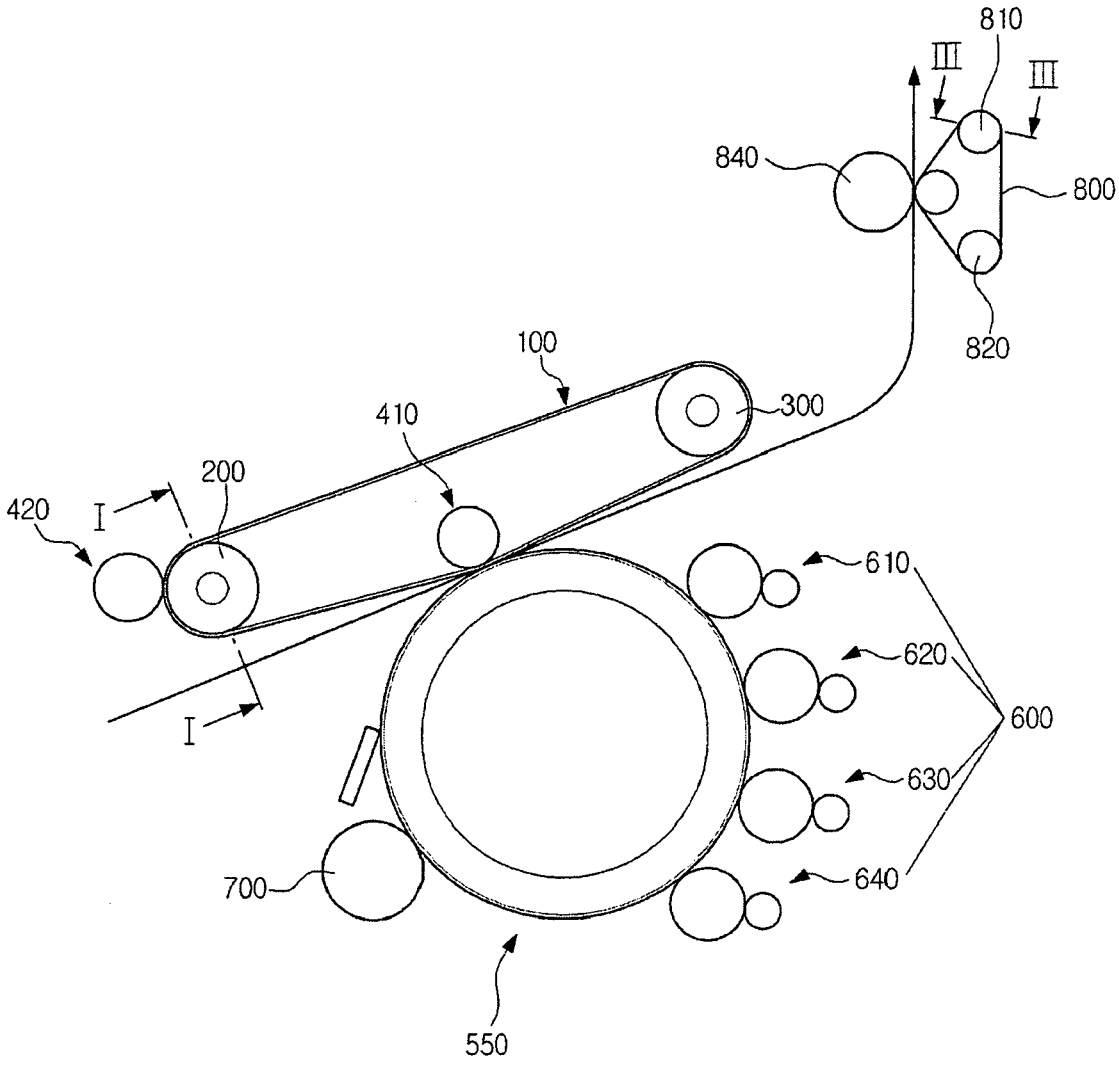
FIG. 1 is a view of an image forming apparatus according to an embodiment.

Reference will now be made in detail to embodiments of the present invention, examples of which are illustrated in the accompanying drawings, wherein like reference numerals refer to like elements. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

Figure 2:
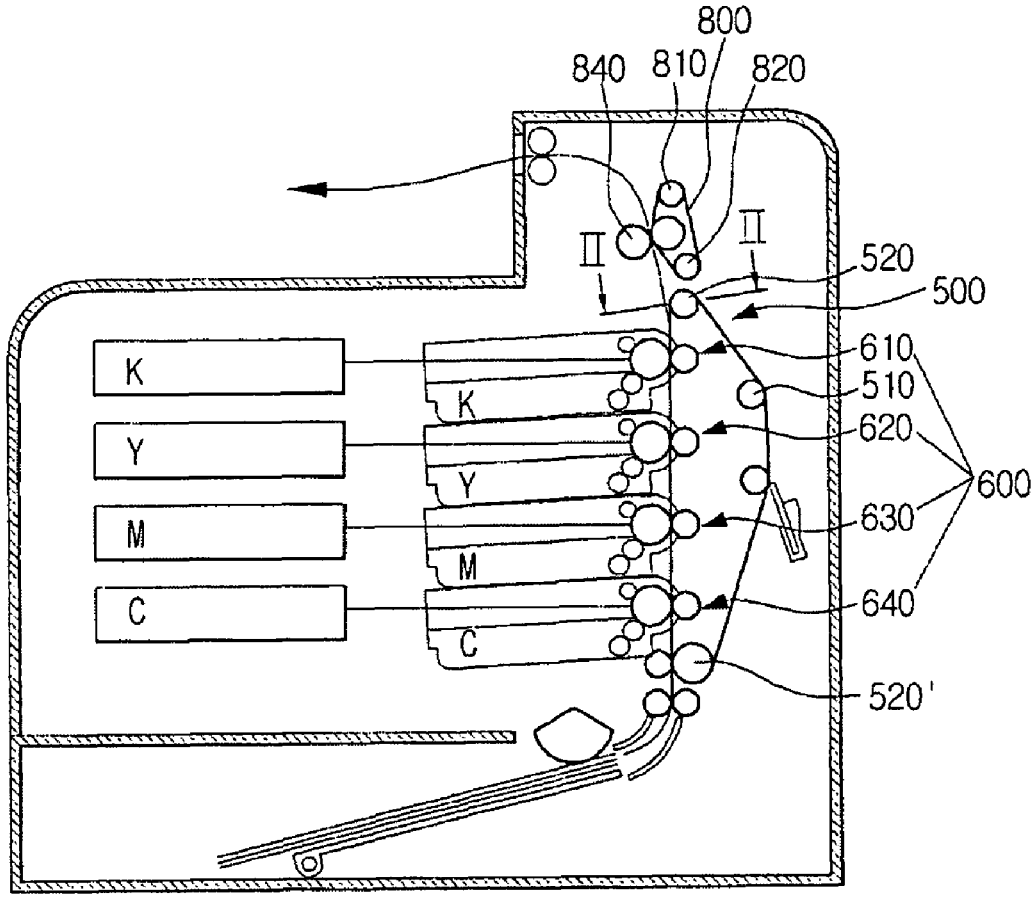
FIG. 2 is a view of an image forming apparatus according to another embodiment.

FIGS. 1 and 2 illustrate image forming apparatuses. Referring to FIG. 1, a charging roller 700 supplies voltage to charge a photoconductive medium. FIG. 1 illustrates an organic photo conductor (OPC) drum 550 employed as the photoconductive-medium. With reference to FIG. 2, another type of photoconductive medium, which includes a photosensitive belt 500, a driving roller 510 to drive the photosensitive belt 500, and supporting rollers 520, 520', is illustrated. The photosensitive belt 500 includes therein a photoconductive material.

When an optical unit (not illustrated) irradiates a laser beam onto the photoconductive medium, thereby exposing the photoconductive medium to light to form thereon an electrostatic latent image, to which as the photoconductive medium rotates respective colors of toner latent images may be formed by a black developing unit 640, a cyan developing unit 630, a magenta developing unit 620, or a yellow developing unit 610. If the OPC drum 550 of FIG. 1 is employed as the photoconductive medium, a toner latent image is formed while the OPC drum is rotated. If the photosensitive belt 500 of FIG. 2 is employed as the photoconductive medium, a toner latent image is formed while the photosensitive belt 500 travels a continuous track.

With reference again to FIG. 1, an intermediate transfer belt 100 may be driven by a driving roller 200 of the belt. Yellow, magenta, cyan, or black toner image may be transferred first onto the intermediate transfer belt 100 due to the voltage fed to a first transfer roller 410. Thus, four color toner images may be overlain on the intermediate transfer belt 100.

When a recording medium, such as a paper sheet, is fed from a feeding unit (not illustrated) and passed between a second transfer roller 420 and the intermediate transfer belt 100, voltage is applied to the second transfer roller 420 to begin a second transfer (i.e. transferring the toner image from the intermediate transfer belt 100 onto the recording medium). After that, the recording medium may be transferred to a fusing device, where the toner image is fixed in place as the recording medium passes through a nip area of a fusing roller, for example. The recording medium with the image fixed thereon may then be discharged out of the image forming apparatus. As illustrated in both FIGS. 1 and 2, the fusing device may include a fusing belt 800, a driving roller 810 to drive the fusing roller, a supporting roller 820, and a fusing roller 840.

Another supporting roller 300 may be provided opposite the driving roller 200 to support the rotation of the intermediate transfer belt 100 along an axis, when the intermediate transfer belt 100 is rotated at the transfer device by the driving roller 200. The transfer belts, including the intermediate transfer belt 100 and a conveyance belt (not illustrated), are rotated as explained above to engage in the transfer of an image.

The transfer belt 100, the photosensitive belt 500, or the fusing belt 800 used in various image forming apparatuses are continuous track belts, which rotate continuously along an axis. Such a continuous track belt contacts other devices, such as, e.g., rollers or a photoconductive medium, during its rotation.

A belt for use in an image forming apparatus according to an embodiment may include a meander prevention guide member including a rubber sheet and a carbon black.

Figure 3A:
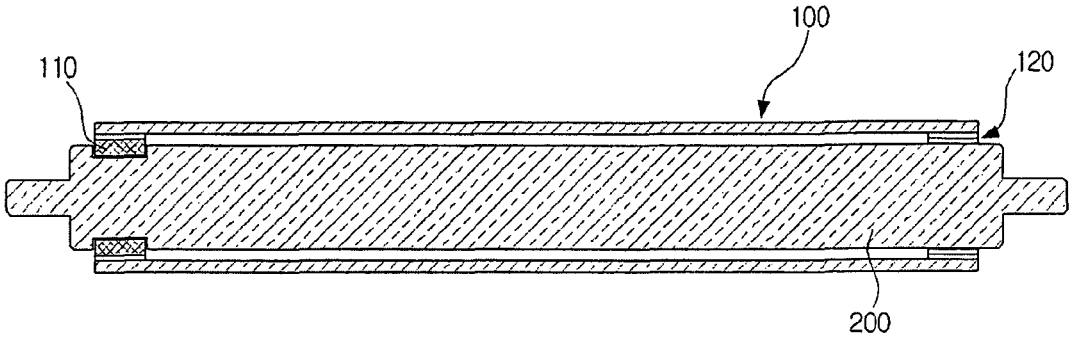
FIG. 3A is a cross-section view of an intermediate transfer belt and a driving roller of the image forming apparatus of FIG. 1, taken on line I-I, according to an embodiment.
Figure 3B:
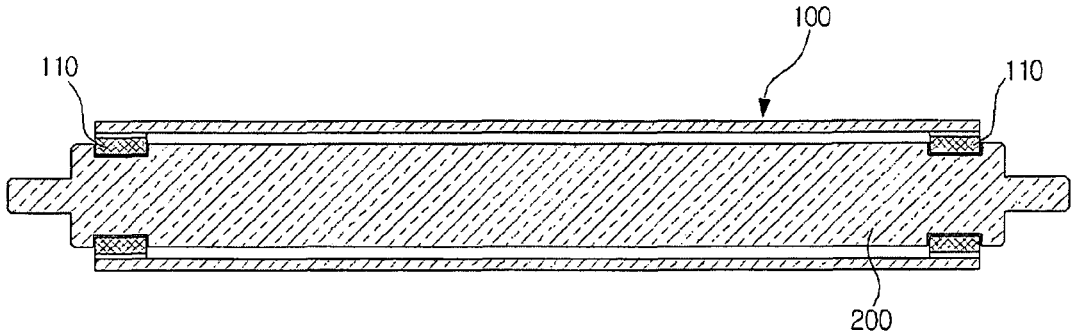
FIG. 3B is a cross-section view of an intermediate transfer belt and a driving roller of the image forming apparatus of FIG. 1, taken on line I-I, according to another embodiment.

FIGS. 3A and 3B are cross-section views of the intermediate transfer belt 100 and the driving roller 200 taken on line I-I of the image forming apparatus of FIG. 1.

Referring to FIG. 3A, the guide member 110 may be positioned on an edge of a side where the intermediate transfer belt 100 is in contact with the roller 200. FIG. 3A illustrates one guide member 110 formed on an edge of one side, and FIG. 3B illustrates two guide members 110 formed on the edge of both sides.

Referring again to FIG. 3A, a reinforcement structure, such as a reinforcement tape 120, may be formed on an edge of a side where the guide member 110 is not formed. The reinforcement tape 120 may be capable of preventing wearing of the transfer belt 100 due to contact with the roller 200.

The driving roller 200 contacting the guide member 110 may include a groove formed on an edge, the contour of which groove corresponding to that of the guide member 110, for allowing a mating-engagement with the guide member 110. Accordingly, the transfer belt 100 is guided along the track during its rotation. The guide member 110 may be formed separately and attached to the transfer belt 100 or, alternatively, may be formed integrally with the transfer belt 100.

The transfer belt 100 may be a semi-conductive seamless belt. The transfer belt 100 may include, e.g., the following materials: polyvinylidene, polytetrafluorethylene(PTFE), polycarbonate, polybutyleneterephthalate, polyimide, or polyamide. According to an embodiment, the polyimide may preferably be used.

In order to fabricate a polyimide transfer belt, first, polyamic acid may be polymerized by reacting acid anhydride and diamine compound with each other.

Next, carbon black may be dispersed in the polyamic acid, with the result applied over a cylindrical metal mould and dried. With imidization, a semi-conductive polyimide transfer belt is completed.

The acid anhydride applicable to the fabrication of a polyimide transfer belt may include, for example: pyromellitic dianhydride(PMDA), phthalic dianhydride(PA), biphenyltetracarboxylic dianhydride(BPDA), 4', 4-oxydiphthalic dianhydride(ODPA), 3',3,4,4'-benzophenonetetracarboxylic dianhydride(BTDA), trimellitic ethylene glycol(TMEG), 4,4'-(4,4'-isopropylbiphenoxy)biphtalic anhydride(BPADA), or trimellitic anhydride(TMA).

The diamine compounds applicable to the fabrication of a polyimide transfer belt may include, for example: p-phenyldiamine(p-PDA), 4,4'-oxydianiline (4,4'-ODA), 2,2-bis(4-(4-aminophenoxy-phenyl)propane(BAPP), p-methylenedianiline(p-MDA), propyltetramethyldisiloxane(GAPD), polyaromatic amine, 4-4'-diaminodiphenyl sulfone, 2,2'-bis(trifluoromethyl)-4,4'-diaminobiphenyl, or 3,5-diamino-1,2,3-triazole.

As for a solvent used in the polymerization of the acid anhydride and the diamine, taking solubility into account, a polar solvent may be used. Solvents applicable may include, for example: N-methyl-2-pyrrolidone(NMP), pyridine, N,N-dimethyl acetamide, N,N-diethyl formamide, N,N-diethyl sulfoxide, dimethyl sulfone, tetramethyl sulfone, or dimethyl tetramethylene sulfone.

In order to give volume resistance and surface resistance to the transfer belt, a conductive additive may be used. The conductive additive may include a conductive carbon black such as, e.g., channel black or furnace black, alone or in combination. The furnace black may preferably be used in certain embodiments.

The furnace black with its surface oxidized has a good affinity to polar solvent due to functional groups, such as carboxyl group, keton group, lactone group, or hydroxyl group, provided to its surface and is also strong against oxidation degradation of the carbon black surface due to electric load. Accordingly, using the oxidized furnace black may improve dispersability in the solvent.

The carbon black added to the transfer belt as the conductive additive may include 1.5% or more of volatile matter. The applicable carbon black may include, for example: FW200, FW2, FW1, Special black 4, Special black 5, Special black 6, S170, S160, Purine texture U, Purine texture V, Special black 550, or Special black 250 (Degussa), MA7, MA77, MA8, or MA11 (Mitsubishi Chemical), or MONARCH 700, MONARCH 800, MONARCH 1000, or VULCAN XC72R (Cabot Corp.).

Carbon black with average particle diameter ranging from about 3 nm to about 70 nm may be used, since those with average particle diameter below 3 nm may be expensive and hardly available so may be uneconomical for the fabrication of transfer belts, while those with an average particle diameter exceeding 70 nm may roughen the surface of polyimide resin, and may thus cause toner filming of a transfer belt. It may be preferable to use the carbon black with an average particle diameter ranging from about 10 nm to about 50 nm in some embodiments.

The amount of conductive carbon black added to the transfer belt is determined with consideration of the type of polymer varnish or particle diameter of the carbon black. 40 wt % or less of carbon black and, more particularly, carbon black ranging from about 6 wt % to about 14 wt %, may be added to 100 wt % of polyimide.

A nonionic polymer dispersant may be added during dispersion of carbon black as a conductive additive to increase the dispersion stability of carbon black particles. The applicable nonionic polymer dispersant may include, for example, one or a combination of two or more of: poly-N-vinyl pyrrolidone, poly-N-vinyl formamide, poly-N-vinyl acetamide and poly-N-vinyl caprolactam.

The amount of polymer dispersant may range from about 1 phr to about 10 phr with respect to weight of carbon black. If the amount of the dispersant does not exceed 1 phr, carbon black may condense or precipitate, causing irregular resistance of the transfer belt. If, on the other hand, the amount of the dispersant exceeds 10 phr, manufacturing price may increase.

The guide member 110 may include a rubber sheet and a carbon black. The rubber sheet may include a polycarbonate urethane rubber sheet or a polyester urethane rubber sheet, for example.

A urethane rubber sheet has high mechanical strength and creep resistance. A urethane rubber sheet may be made by mixing a urethane elastomer prepolymer, which is made by partially polymerizing polyisocyinate and polyol, with a curing agent as a chain extender, injecting the result in a metal mould, and performing heating and curing. The guide member 110 may be completed by cutting the above urethane rubber sheet with a Thompson cutter, for example.

The polyisocyanate may include one or a combination of two or more of trimetylhexametylene diisocynate, naphthalene diisocynate, dimetyl diisocyanate, toluene diisocyanate (TDI), diphenylmethan diisocynate(MDI), or 1,6-hexamethylene diisocynate. However, the polyisocynate is not limited to the above examples.

The polyol applicable according to an embodiment may include one or a combination of two or more of ethylene glycol, trimethyolpropane, triethanolamine, diethylene glycol, or dipropylene glycol. However, the polyol is not limited to the above examples.

The chain extender applicable according to an embodiment may include 1,4-butanediol, clycerine, hexamethylenediamine, or hydrazine, but is not limited thereto.

In fabricating a urethane rubber sheet, a catalyst may be used to promote a curing reaction. The catalyst promotes a curing reaction and shortens a molding cycle, and, therefore, may increase production efficiency. The catalyst may include, for example, amine compound, such as tertiary amine, or organic metal compound, but is not limited thereto.

The carbon black may be added to the urethane rubber sheet to increase abrasion resistance of the guide member 110. The abrasion resistance has a relation with the primer particle diameter, that is, with the size of the carbon black structure. The carbon black of less primer particle diameter, that is, the carbon black of larger surface area, may contribute to a higher abrasion resistance of the guide member 110 made using urethane rubber sheet.

The carbon black according to an embodiment may have a primer particle diameter ranging from about 15 nm to about 35 nm. The primer particle diameter herein refers to an average diameter of primer particles in the state before undergoing any treatment. If the primer particle diameter of the carbon black does not exceed 15 nm, dispersability may decease, causing difficulty in the processing. If the primer particle diameter exceeds 30 nm, a sufficient level of abrasion resistance may not be obtained.

Additionally, the carbon black according to an embodiment may have a specific surface area of nitrogen absorption ranging from about 80 $mg^2/g$ to about 140 $mg^2/g$. If the specific surface area of nitrogen absorption does not exceed 80 $mg^2/g$, a sufficient level of abrasion resistance may not be obtained, and if the specific surface area of nitrogen absorption exceeds 140 $mg^2/g$, dispersability may decrease, causing difficulty in the processing.

The carbon black applicable according to an embodiment may include two or more selected from: Super Abrasion Furnace(SAF) carbon black, Super Abrasion Furnace-High Structure(SAF-HS) carbon black, Intermediate Super Abrasion Furnace(ISAF) carbon black, Intermediate Super Abrasion Furnace-High Structure(ISAF-HS) carbon black, or High Abrasion Furnace(HAF) carbon black.

The carbon blacks may be named according to the American standard test method(ASTM) standards, for example, ASTM code, and the SAF carbon black may be named as N100, the ISAF carbon black may be named as N200, and the HAF carbon black may be named as N300, for example.

According to an embodiment, the amount of carbon black added to the fabrication of the guide member may range from about 20 phr to about 40 phr with respect to the urethane rubber. If the amount of carbon black does not exceed 20 phr, a sufficient level of abrasion resistance may not be obtained, and if the amount exceeds 40 phr, processing may become difficult.

The primer particle diameter of the carbon black may be obtained by measuring the diameters of the carbon black particles with an electron microscope, such as scanning electron microscope(SEM) or transmission electron microscope (TEM), and averaging the measured diameters.

The specific surface area of nitrogen absorption may be measured with JIS K 6217, for example.

Figure 4A:
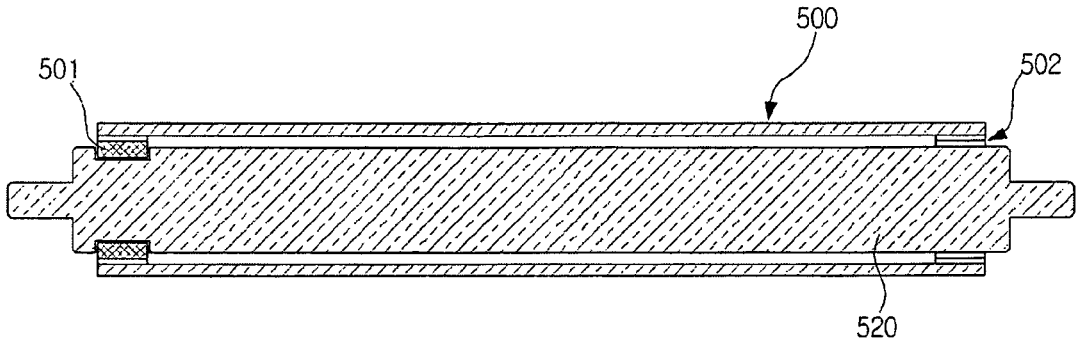
FIG. 4A is a cross-section view of a photosensitive belt and a supporting roller of the image forming apparatus of FIG. 2, taken on line II-II, according to an embodiment.
Figure 4B:
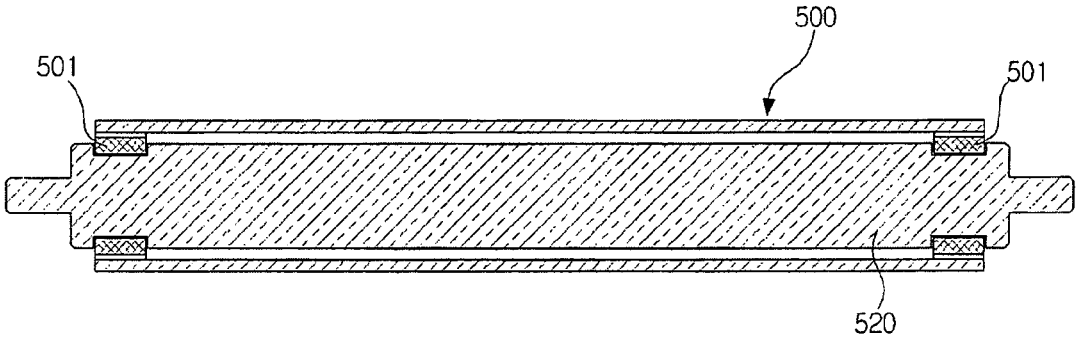
FIG. 4B is a cross-section view of a photosensitive belt and a supporting roller of the image forming apparatus of FIG. 2, taken on line II-II, according to another embodiment.

FIGS. 4A and 4B are cross-section views of the photosensitive belt 500 and the supporting roller 520 of the image forming apparatus of FIG. 2, taken on line II-II.

Referring to FIG. 4A, a guide member 501 may be located on an edge of a side of the photosensitive belt 500 that contacts the roller 520. FIG. 4A illustrates one guide member 501 formed on one edge, and FIG. 4B illustrates two guide members 501 formed on the edges of both sides.

Referring again to FIG. 4A, a reinforcement structure, such as a reinforcement tape 502, may be formed on an edge of a side where the guide member 501 is not formed. The reinforcement tape 502 may be capable of preventing wearing of the photosensitive belt 500 due to contact with the roller 520.

The supporting roller 520 contacting the guide member 501 may include a groove formed on an edge in a contour corresponding to that of the guide member 501, allowing mate-engagement with the guide member 501. Accordingly, the photosensitive belt 500 is guided along the track during its rotation. The guide member 501 may be formed separately and attached to the photosensitive belt 500, or alternatively, the guide member 501 may be formed integrally with the photosensitive belt 500.

The photosensitive belt 500 may be fabricated with adequate known methods. Furthermore, the guide member 501 for a photosensitive belt 500 may be fabricated in the same manner as the guide member 110 of the transfer belt 100 explained above.

Figure 5A:
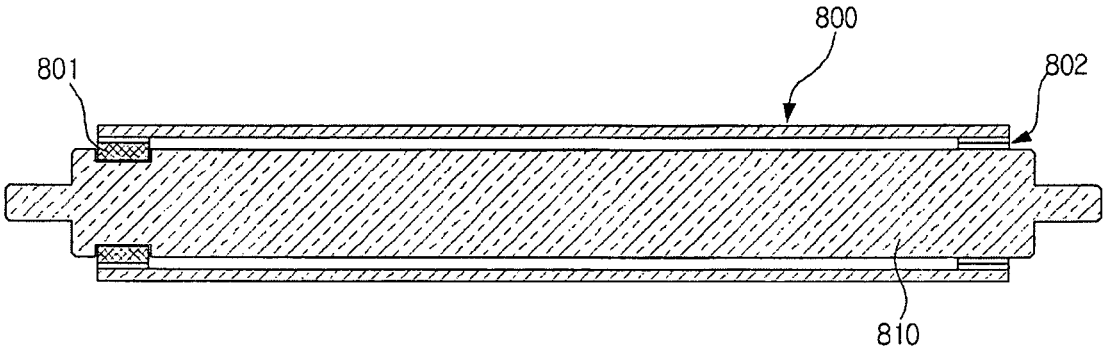
FIG. 5A is a cross-section view of a fusing belt and a driving roller of the image forming apparatus of FIG. 1, taken on line III-III, according to an embodiment.
Figure 5B:
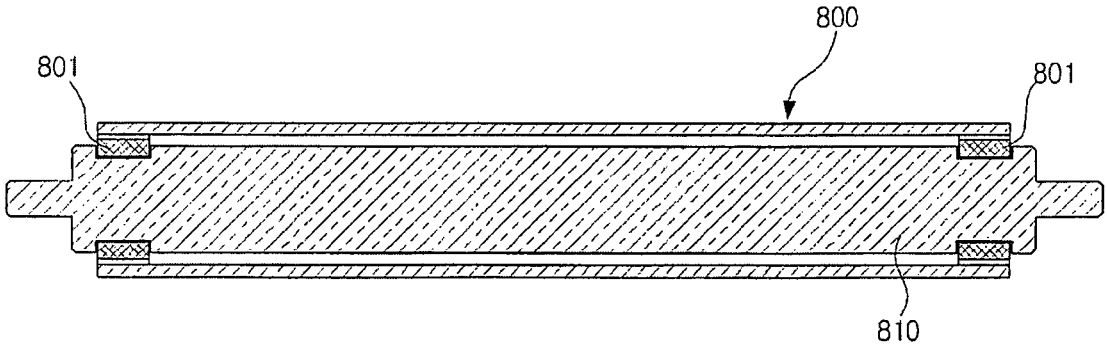
FIG. 5B is a cross-section view of a fusing belt and a driving roller of the image forming apparatus of FIG. 1, taken on line III-III, according to another embodiment.

FIGS. 5A and 5B are cross-section views of the fusing belt 800 and the driving roller 810 of the image forming apparatus of FIG. 1, taken on line III-III.

Referring to FIG. 5A, a guide member 801 may be located on an edge of a side of the fusing belt 800 that contacts the roller 810. FIG. 5A illustrates one guide member 801 formed on one edge, and FIG. 5B illustrates two guide members 801 formed on the edges of both sides.

Referring again to FIG. 5A, a reinforcement structure, such as a reinforcement tape 802, may be formed on an edge of a side where the guide member 801 is not formed. The reinforcement tape 802 may be capable of preventing wearing of the fusing belt 800 due to contact with the roller 810.

The driving roller 810 contacting the guide member 801 may include a groove formed on an edge in a contour corresponding to that of the guide member 801, allowing mate-engagement with the guide member 801. Accordingly, the fusing belt 800 is guided along the track during its rotation. The guide member 801 may be formed separately and attached to the fusing belt 800, or alternatively, the guide member 801 may be formed integrally with the fusing belt 800.

The process of fabricating a transfer belt including a guide member according to one embodiment is explained below.

EXAMPLE 1

Fabrication of Transfer Belt

| <Conductive polyimide varnish> | |
|---|---|
| Polyimide varnish (U-nis, Ube Industries Inc.) | 100 phr |
| Carbon black (Special black 4, Degussa) | 20 phr |
| Dispersant (NMP 90 wt %, poly-N-vinyl pyrrolidone 10 wt %) | 10 phr |
| N-methyl-2-pyrrolidone | 500 phr |

A conductive polyimide varnish was fabricated by dispersing the above ingredients at 300 rpm for 5 hours.

<Semi-Conductive Seamless Transfer Belt>

In a metallic cylindrical receptacle (thickness: 3 mm) having inner diameter of 376 mm and length of 280 mm, 30 g of the above conductive polyimide varnish was injected and evenly applied over the inner surface of the receptacle while rotating at 100 rpm.

After rotation of 3 minutes, the content was injected into a forced convection drying oven at temperature of 120° C., while rotating. The imidization reaction was finished by increasing the temperature of the forced convection drying oven up to 310° C. for 4 hours.

Next, the content was left to cool slowly in the air, and a conductive layer was separated off from the inner surface of the cylindrical receptacle, and both ends were cut to fit to the dimensions.

As a result, a semi-conductive seamless transfer belt having thickness of 70 μm was fabricated.

| <Guide member> | |
|---|---|
| Polyisocyanate | 27 phr |
| Polyester polyol | 69 phr |
| 1,4-butandiol | 4 phr |
| Amine compound catalyst | 0.02 phr |
| Corax N220 | 30 phr |

Corax N220 is Korea carbon black, having a primer particle diameter falling into a range of 20 nm and 25 nm and a specific surface area of nitrogen absorption of 119 $mg^2/g$.

The above ingredients were prepared. First, a propolymer was prepared by partially polymerizing the polyisocyanate and the polyester polyol, mixing the prepared propolymer with 1,4-butanediol and amine compound catalyst, injecting the result into a metal mould, and heating the content.

As a result, the guide member was fabricated.

Fabrication of a Transfer Belt having a Guide Member

The acrylic primer was coated on an end of the above semi-conductive seamless polyimide belt and dried, and the above guide member was attached using a both-side adhesive. The result was then cut with a Thomson cutter. A sensor window was made in a side opposite the guide member. As a result, a transfer belt having a guide member was fabricated.

EXAMPLE 2

Example 2 has one difference from Example 1, in that Example 2 uses 30 phr of Corax N 326 as the carbon black to fabricate a transfer belt having a guide member.

Corax N 326 is Korea carbon black, having a primer particle diameter falling into a range of 26 nm and 30 nm and a specific surface area of nitrogen absorption of 84 $mg^2/g$.

Comparative 1

Comparative 1 has one difference from Example 1, in that Comparative 1 uses 30 phr of Corax HP 1107 as the carbon black to fabricate a transfer belt having a guide member.

Corax HP 1107 is Korea carbon black, having a primer particle diameter falling into a range of 10 nm and 14 nm and a specific surface area of nitrogen absorption of 147 $mg^2/g$.

Comparative 2

Comparative 2 has one difference from Example 1, in that Comparative 2 uses 30 phr of Corax N 550 as the carbon black to fabricate a transfer belt having a guide member.

Corax N 550 is Korea carbon black, having a primer particle diameter falling into a range of 40 nm and 48 nm and a specific surface area of nitrogen absorption of 42 $mg^2/g$.

Comparative 3

Comparative 3 has one difference from Example 1, in that Comparative 3 does not use the carbon black to fabricate a transfer belt having a guide member.

{Evaluation}

The transfer belt having a guide member according to Examples 1 and 2 and Comparatives 1, 2, and 3 was evaluated taking into account hardness, coefficient of abrasion, performance of guide member, degree of abrasion of the guide member after 50,000 sheets of an image quality test, and degree of guide member meandering after 50,000 sheets of image quality test.

Hardness

The hardness was measured based on Asker A type.

As a result of the hardness measurement, the guide member according to Example 1 has hardness 74, Example 2 has hardness 75, Comparative 1 has hardness 75, Comparative 2 has hardness 75, and Comparative 3 has hardness 70. The result indicates that the guide member including the carbon black has a higher hardness than the guide member that does not include carbon black (Comparative 3), regardless of the primer particle diameter of the carbon black.

Coefficient of Abrasion

The coefficient of abrasion was measured based on:

$$\text{Coefficient of abrasion} = \text{Amount of abrasion}/(\text{Weight} \times \text{density} \times \text{distance} \times \text{time of driving}) \quad \text{[Mathematical formula 1]}$$

where, a weight is 20 kgf, a distance is 100 mm, a relative abrasion radius is 11.4, a time of driving is 1 hour, a rotational force is 100 mm/sec, a temperature is 25±5° C., and a humidity is 45±5%. Herein, a degree of abrasion with respect to relative material UHMW-PE was measured. The unit of abrasion coefficient is $cm^3 \cdot sec/kgf \cdot m \cdot hr$. As a result of measuring a coefficient of abrasion, the guide member according to Example 1 exhibited $1.78 \times 10^{-3}$ $cm^3 \cdot sec/kgf \cdot m \cdot hr$, Example 2 exhibited $2.02 \times 10^{-3}$ $cm^3 \cdot sec/kgf \cdot m \cdot hr$, Comparative 1 exhibited $2.57 \times 10^{-3}$ $cm^3 \cdot sec/kgf \cdot m \cdot hr$, Comparative 2 exhibited $3.25 \times 10^{-3}$ $cm^3 \cdot sec/kgf \cdot m \cdot hr$, and Comparative 3 exhibited $4.57 \times 10^{-3}$ $cm^3 \cdot sec/kgf \cdot m \cdot hr$.

In conclusion, the guide members according to Examples 1 and 2 showed the lowest coefficient of abrasion, and the guide member including no carbon black according to Comparative 3 showed the highest abrasion coefficient. Accordingly, the guide members of Examples 1 and 2 have the lowest degree of abrasion.

Performance of Guide Member

As a result of evaluating performance of the guide member, the guide members of Examples 1 and 2 and Comparatives 2 and 3 indicated good performance. However, it was difficult to complete a guide member according to the specifications of Comparative 1 using Corax HP 1107 of small primer particle diameter, and thus it was difficult to observe the performance of the guide member of Comparative 1 with accuracy.

Degree of Abrasion of Guide Member After 50,000 Sheets of Image Quality Test

The degree of abrasion of the guide member was evaluated with naked eyes, after performing 50,000 sheets of printing. Specifically, image contamination due to dust from the guide member was checked with naked eyes.

Examples 1 and 2 and Comparative 1 showed uncompromised image quality and included no stain on an image after printing 50,000 sheets of images. However, Comparatives 2 and 3 suffered a rather high degree of abrasion of the guide member after printing 50,000 sheets, resulting in severe stain on the images due to dust contamination.

Meandering of Guide Member After 50,000 Sheet Printing Test

Examples 1 and 2 had no problem with the performance of the guide member and thus had no meandering of a transfer belt after printing 50,000 sheets of images. However, Comparatives 2 and 3 had a rather high degree of abrasion of the guide member, in which the guide member eventually failed to prevent meandering of the transfer belt. It was difficult to complete a guide member according to Comparative 1, using Corax HP 1107 of small primer particle diameter, and thus Comparative 1 failed to prevent the meandering of a transfer belt, due to the incompleteness of the guide member according to Comparative 1 and not the degree of abrasion of the guide member.

The results of test are summarized as below:

| | Example 1 | Example 2 | Comparative 1 | Comparative 2 | Comparative 3 |
|---|---|---|---|---|---|
| Carbon black | Corax N220 | Corax N326 | Corax HP1107 | Corax N550 | None |
| Hardness (Asker A type) | 74 | 75 | 75 | 75 | 70 |
| Coefficient of abrasion ($cm^3 \cdot sec/kgf \cdot m \cdot hr$) | $1.78 \times 10^{-3}$ | $2.02 \times 10^{-3}$ | $2.57 \times 10^{-3}$ | $3.25 \times 10^{-3}$ | $4.57 \times 10^{-3}$ |

-continued

| | Example 1 | Example 2 | Comparative 1 | Comparative 2 | Comparative 3 |
|---|---|---|---|---|---|
| Performance of guide member | Good | Good | Inconclusive | Good | Good |
| Abrasion of guide member after 50,000 sheet image test | Good | Good | Good | Bad | Bad |
| Meandering of guide member after 50,000 sheet image test | Good | Good | Inconclusive | Bad | Bad |

As a result, the guide members of Examples 1 and 2 were determined to be suitable as belt meander prevention members, with which a guide member may have increased abrasion resistance and no image contamination even after a long period of use.

According to the embodiments explained above, a preferred guide member will not wear out even after long use. Accordingly, a belt having the guide member and an image forming apparatus incorporating the belt with guide member according to the described embodiments have a near-constant degree of image quality, no belt meander, and stable performance in several processes, such as light exposure and image transfer and fusing.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A guide member for use with a belt, formed on an inner side surface of the belt configured to prevent a belt meandering from a track, the guide member comprising a rubber sheet and a carbon black material and having a composition different from a composition of the belt, wherein the carbon black material has a primer particle diameter ranging from about 15 nm to about 35 nm.

2. The guide member of claim 1, wherein the carbon black material is a compound of two or more of materials selected from the group of Super Abrasion Furnace (SAP) carbon black, Super Abrasion Furnace-High Structure (SAF-HS) carbon black, Intermediate Super Abrasion Furnace (ISAF) carbon black, Intermediate Super Abrasion Furnace-High Structure (ISAF-HS) carbon black and High Abrasion Furnace (I-IAF) carbon black.

3. The guide member of claim 1, wherein the rubber sheet comprises the carbon black material in an amount ranging from about 20 phr to about 40 phr.

4. The guide member of claim 1, wherein the belt comprises one of a photosensitive belt, a fusing belt and a transfer belt.

5. A belt for use in an image forming apparatus, the belt configured to travel a continuous track, the belt comprising:

a guide member formed on a surface of the belt configured to prevent the belt from meandering off of the track and having a composition different from a composition of the belt, wherein the guide member comprises a rubber sheet and a carbon black material having a primer particle diameter ranging from about 15 nm to about 35 nm.

6. The belt of claim 1, wherein the carbon black material comprises a specific surface area of nitrogen absorption ranging from about 100 $mg^2/g$ to about 150 $mg^2/g$.

7. The belt of claim 1, wherein the carbon black material comprises a compound of two or more of materials selected from the group of Super Abrasion Furnace (SAF) carbon black, Super Abrasion Furnace-High Structure (SAF-HS) carbon black, Intermediate Super Abrasion Furnace (ISAF) carbon black, Intermediate Super Abrasion Furnace-High Structure (ISAF-HS) carbon black and High Abrasion Furnace (HAF) carbon black.

8. The belt of claim 1, wherein the rubber sheet comprises one of a polycarbonate urethane rubber sheet and a polyester urethane rubber sheet.

9. The belt of claim 1, wherein the rubber sheet comprises the carbon black material in an amount ranging from about 20 phr to about 40 phr.

10. The belt of claim 1, wherein the belt comprises one of a photosensitive belt, a fusing belt and a transfer belt.

11. An image forming apparatus, comprising:

a belt configured to travel a continuous track;

a driving roller configured to drive the belt; and a supporting roller configured to support the belt, wherein the belt includes a guide member formed on a surface of the belt configured to prevent the belt from meandering off of the track and having a composition different from a composition of the belt, wherein the guide member comprises a rubber sheet and a carbon black material having a primer particle diameter ranging from about 15 nm to about 35 nm.

12. The image forming apparatus of claim 11, wherein the carbon black material comprises a compound of two or more of materials selected from the group of Super Abrasion Furnace (SAF) carbon black, Super Abrasion Furnace-High Structure (SAFFHS) carbon black, Intermediate Super Abrasion Furnace (ISAF) carbon black, Intermediate Super Abrasion Furnace-High Structure (ISAF-HS) carbon black and High Abrasion Furnace (I-IAF) carbon black.

13. The image forming apparatus of claim 11, wherein the rubber sheet comprises the carbon black material in an amount ranging from about 20 phr to about 40 phr.

14. The image forming apparatus of claim 11, wherein the belt comprises one of a photosensitive belt, a fusing belt and a transfer belt.

15. The image forming apparatus of claim 11, wherein the belt comprises:

a reinforcement structure configured to prevent wearing of the belt, the reinforcement structure formed on an edge where the belt is in contact with the driving roller or the supporting roller, wherein the reinforcement structure comprise a reinforcement tape material.

16. The image forming apparatus of claim 11, wherein the driving roller comprises a groove formed on an edge thereof, wherein a contour of the guide member corresponds to the groove for engagement between the driving roller and the guide member.

17. The belt image forming apparatus of claim 11, wherein the supporting roller comprises a groove formed on an edge thereof, wherein a contour of the guide member corresponds to the groove for engagement between the supporting roller and the guide member.

* * * * *